US007552495B1

(12) United States Patent
Rogerson

(10) Patent No.: US 7,552,495 B1
(45) Date of Patent: Jun. 30, 2009

(54) ADAPTABLE INSERTS FOR JET SKI RAMP

(76) Inventor: L. Keith Rogerson, #9 Fourth Ave., Isle of Palms, SC (US) 29451

( * ) Notice: Subject to any disclaimer, the term of this patent is extended or adjusted under 35 U.S.C. 154(b) by 0 days.

(21) Appl. No.: 12/028,437

(22) Filed: Feb. 8, 2008

(51) Int. Cl.
*B63C 5/00* (2006.01)

(52) U.S. Cl. ..... 14/69.5; 405/7; 114/263

(58) Field of Classification Search ..... 114/230.1, 114/263, 382; 14/69.5; 405/7
See application file for complete search history.

(56) References Cited

U.S. PATENT DOCUMENTS

| | | | | |
|---|---|---|---|---|
| 4,260,282 | A | 4/1981 | Dorsey et al. | |
| 4,938,629 | A | 7/1990 | Boudrias | |
| 5,529,013 | A | 6/1996 | Eva, III et al. | |
| 5,682,833 | A | 11/1997 | Eva, III et al. | |
| 5,795,098 | A * | 8/1998 | Rueckert | 405/7 |
| D398,576 | S | 9/1998 | Hillman et al. | |
| 5,875,727 | A | 3/1999 | Elson et al. | |
| 5,931,113 | A | 8/1999 | Eva, III et al. | |
| 5,941,660 | A * | 8/1999 | Rueckert | 405/7 |
| 5,947,050 | A | 9/1999 | Eva, III et al. | |
| 6,308,652 | B1 | 10/2001 | O'Neill | |
| 6,431,106 | B1 | 8/2002 | Eva, III et al. | |
| 6,526,902 | B1 | 3/2003 | Faber | |
| 6,745,714 | B1 | 6/2004 | Faber | |
| D506,431 | S | 6/2005 | Elson | |
| 7,051,668 | B1 * | 5/2006 | Quinto et al. | 114/263 |
| 7,055,449 | B2 * | 6/2006 | Brown | 114/263 |
| 7,063,033 | B1 | 6/2006 | Jackson | |
| 7,069,872 | B2 * | 7/2006 | Ostreng et al. | 114/263 |
| 7,117,809 | B2 * | 10/2006 | Lamoureux et al. | 114/263 |
| 7,213,531 | B2 * | 5/2007 | Ahern | 114/263 |
| 7,267,071 | B2 * | 9/2007 | Brown | 114/263 |
| 7,293,522 | B1 * | 11/2007 | Elson | 114/263 |
| 2004/0018054 | A1 * | 1/2004 | Rueckert | 405/7 |
| 2004/0169678 | A1 * | 9/2004 | Oliver | 345/738 |

OTHER PUBLICATIONS

Bregar, Bill, "Rotomolded Fencing Mimics Stacked Stone," PlasticsNews, Aug. 13, 2007, p. 1, 17, A Crain Publication, Crain Communications, Inc.

* cited by examiner

*Primary Examiner*—Gary S Hartmann
(74) *Attorney, Agent, or Firm*—Turmer Padget Graham & Laney, P.A.

(57) ABSTRACT

A modular jet ski ramp includes a platform configured to float on water and for attachment to a dock. The platform has a receptacle thereon for a replaceable insert, which has a docking surface and an attachment surface. The docking surface is complementary to a hull of a jet ski. The attachment surface is complementary to the receptacle for attachment thereto. The replaceable insert is configured for removal and replacement such that the platform can accommodate the jet ski and another jet ski of a different size.

16 Claims, 8 Drawing Sheets

ADAPTABLE INSERTS FOR JET SKI RAMP

BACKGROUND OF THE DISCLOSURE

Floating jet ski ramps are known, which are attached to docks, piers, and the like for dry-docking jet skis above a water surface. Conventional jet ski ramps are constructed unitarily with generally concave upper surfaces. These concave surfaces are generic docking surfaces that are purported to accommodate any and all jet skis.

At least one drawback to the conventional jet ski ramp is that over time the upper surface wears out due to repeated docking and undocking of the jet ski. Once the upper surface wears out, the jet ski ramp may be unserviceable. Typically, it is more cost efficient to replace the entire jet ski ramp rather than attempt to refurbish the upper surface.

A further drawback of the conventional jet ski ramp is its attempt to accommodate all brands of jet skis with the generic upper surface. In today's competitive marketplace, jet ski manufacturers regularly redesign hulls of their jet skis to make the jet skis faster and more efficient and therefore, more attractive to the consumer. Some jet ski hulls are so radically different from the generic concave surface, that the jet skis cannot dock and undock smoothly and efficiently from the generic jet ski ramp.

What is needed in the industry is a jet ski ramp that may be easily refurbished or retrofitted with an upper wear surface to accommodate various hull designs from various jet ski manufacturers.

BRIEF SUMMARY OF THE DISCLOSURE

The present disclosure is directed to modular jet ski ramps, each generally having a removable and replaceable upper wear surface or insert that may be readily removed and replaced once an original upper wear surface reaches the end of its service life. Alternatively or additionally, the original upper surface can be replaced with a different upper surface to accommodate a different or unique hull design of another jet ski. Accordingly, an owner of a jet ski ramp will realize cost savings by extending the life of the jet ski ramp and/or by modifying the jet ski ramp to accommodate a different hull design than that of the jet ski for which the ramp may have been originally purchased.

According to one aspect of the present disclosure, a modular jet ski ramp includes a platform being configured to float on water and for attachment to a dock, the platform defining a receptacle thereon; and a replaceable insert having a docking surface and an attachment surface, the docking surface being complementary to a hull of a jet ski, the attachment surface being complementary to the receptacle for attachment thereto, wherein the replaceable insert is configured for removal and replacement to accommodate the hull of the jet ski and another jet ski having a different hull. The platform may be made of polyethylene having foam floatation, such as polystyrene, inserted internally.

In this aspect of the disclosure, a replaceable bow guide may be attachable and detachable to one or both of the platform and the insert. The replaceable bow guide serves to guide and stop the jet ski upon docking. If desired, two or more replaceable bunks may be attached to the platform and/or the insert. Moreover, the insert may include one or more removable rollers located in or on the docking surface to dock and undock the jet ski. Also, a non-skid surface may be employed near the insert to prevent slippage.

The present embodiment may also include an attachment system for attaching the platform to the dock. The attachment system may include an equipment storage compartment, which also serves to prevent torsion between the platform and the dock; in other words, to prevent twisting of the platform relative to the dock. The modular jet ski ramp may also include an endoskeleton in the platform to make the platform rigid and to oppose platform twisting or bending.

In another particular embodiment, a modular jet ski ramp may have a floatation-capable platform, which can be attached to a dock. The platform may have a receptacle and a replaceable insert having a docking surface and an attachment surface. The docking surface is complementary to a hull of a jet ski. The attachment surface is complementary to the receptacle for attachment to the receptacle. In this embodiment, the replaceable insert is configured for removal and replacement to accommodate the hull of the jet ski as well as other jet skis of different sizes. The replaceable insert includes at least one removable roller disposed upon the docking surface configured to dock and undock the jet ski.

In a further embodiment, a modular jet ski ramp includes a platform configured to float on water and for attachment to a dock, the platform defining a receptacle thereon; a replaceable insert having a docking surface and an attachment surface, the docking surface being complementary to a hull of a jet ski, the attachment surface being complementary to the receptacle for attachment thereto, wherein the replaceable insert is configured for removal and replacement to accommodate the hull of the jet ski and another jet ski having a different hull; and an attachment system for attaching the platform to the dock, the attachment system including an equipment storage compartment and being further configured to prevent torsion between the platform and the dock.

In this embodiment, the attachment system may include a key, and the platform includes a keyhole for reception of the key to lock the components together and make the modular jet ski ramp rigid.

Evident from the foregoing introduction, the component parts of the jet ski ramp are simple and economical to manufacture and use. Other advantages of the disclosure will be apparent from the following description and the attached drawings or can be learned from practice of the disclosure.

BRIEF DESCRIPTION OF THE DRAWINGS

The foregoing and other features, aspects and advantages of the present disclosure will be apparent from the detailed description below in combination with the drawings, in which.

Figure 1A:
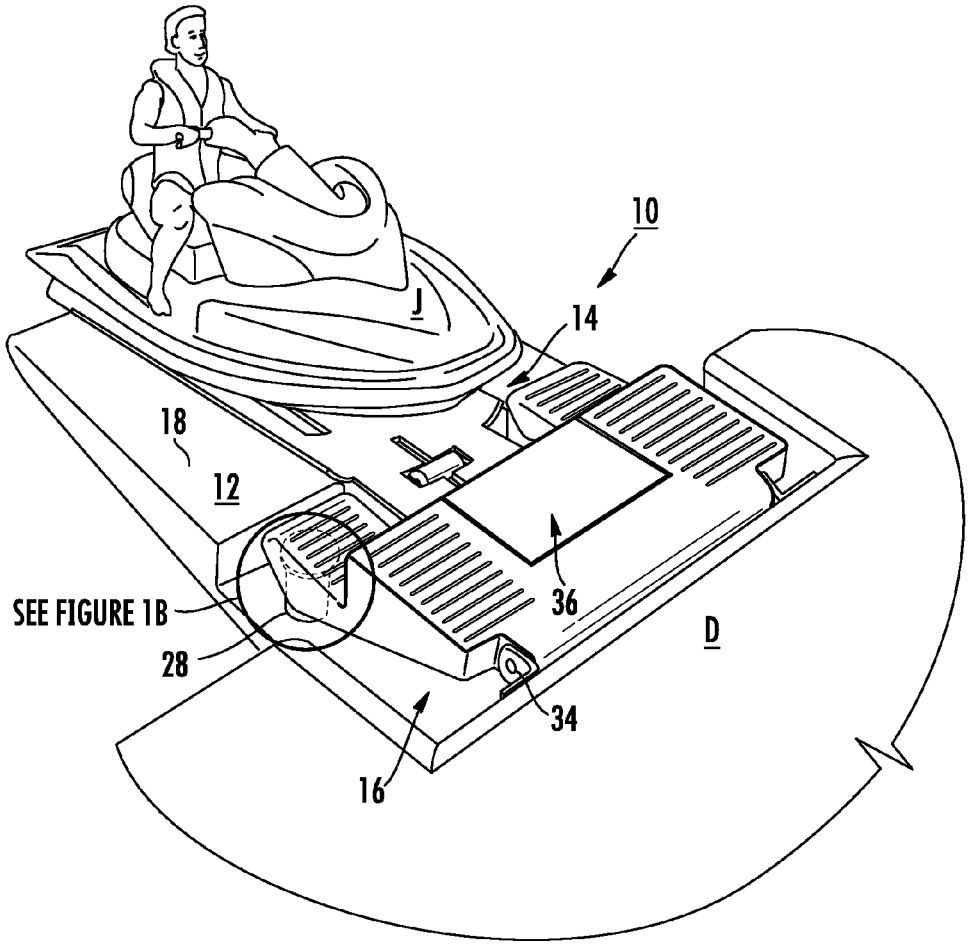
FIGS. 1A and 1B are a perspective view of an embodiment of a jet ski ramp shown in use in an intended environment according to an aspect of the disclosure.

Detailed reference will now be made to the drawings in which examples embodying the present disclosure are shown. The detailed description uses numerical and letter designations to refer to features of the drawings. Like or similar designations of the drawings and description of the views refer to like or similar parts of various embodiments according to the disclosure.

DETAILED DESCRIPTION OF THE DISCLOSURE

The drawings and detailed description provide a full and detailed written description of the disclosure and of the manner and process of making and using various embodiments, so as to enable one skilled in the pertinent art to make and use them, as well as the best mode of carrying out the disclosure. However, the examples set forth in the drawings and detailed description are provided by way of explanation of the disclosure and are not meant as limitations of the disclosure. The present disclosure thus includes any modifications and variations of the following examples as come within the scope of the appended claims and their equivalents.

Turning now to the figures, according to one aspect of the disclosure a jet ski ramp system, designated in general by the element number 10, broadly includes a platform 12, an insertable or replaceable wear surface or insert 14, and an attachment system 16. As will be described in detail herein, these and other components of the jet ski ramp system 10 are lightweight and modular and may be easily removed, serviced and/or replaced to extend a service life of the jet ski ramp 10 or to modify the jet ski ramp 10 to accommodate different types of jet skis, designated generally by the letter J. As also will be described herein, the jet ski ramp 10 may be attached to a dock D or similar structure to create an extension of the dock D as well as to provide a floating dry dock to elevate the jet ski J above a water surface to protect the jet ski J from marine life, corrosion and general exposure to water while the jet ski J is not in use. Preferably, at least the platform 12 of the jet ski ramp system 10 is made of a durable, weather resistant material such as including a polyethylene shell to withstand exposure as might be encountered in a marina environment.

Figure 1B:
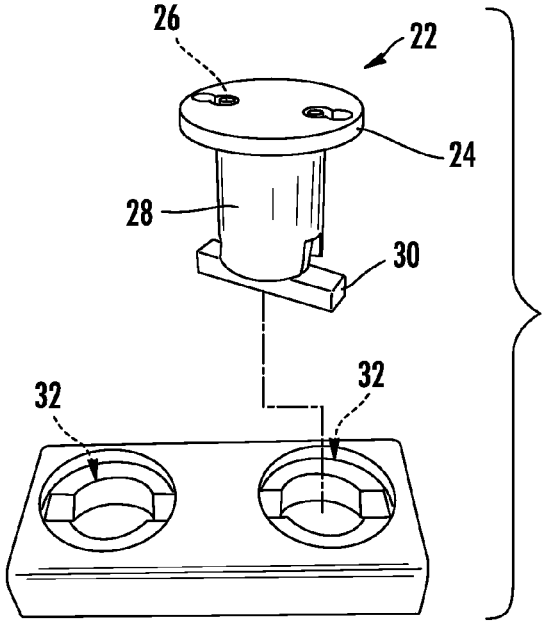

With particular reference to FIGS. 1A and 1B, the jet ski ramp system 10 includes the platform 12 and the insert 14 briefly introduced above. In this example, the jet ski ramp 10, and more particularly the platform 12, is attached to the dock D by the attachment system 16. As shown, the attachment system 16 may include a key 22, which is inserted into an aperture or a keyhole 32 of the platform 12 to attach the platform 12 to the dock D. In this example, the key 22 includes a top 24 having a rotation device or aperture 26 for rotating the key 22 in the keyhole 32 as will be described in greater detail below. The key 22 also includes a body 28 from which a key bar 30 extends. As shown, the keyhole 32 may include multiple keyholes 32 to attach the platform 12 to the dock D and/or to another platform 12. In use, the key 22 is inserted in the keyhole 32 as shown and rotated or turned using the rotation device 26, which may be in the form of a latch or handle that is flush with the top 24 when not in use and extendable to rotate the key 22 such that the key bar 30 is rotated within the keyhole 32 to prevent retraction from the key 22 from the keyhole 32. The key 22 may be made of polyethylene, or other hardened plastic, or any other weather durable material to complement the platform 12. Moreover, the skilled artisan will appreciate that the key 22 and the keyhole 32 may be shaped differently than the examples shown. Also, a locking interaction between the key 22 and the keyhole 32 may be a press- or snap-fit interaction instead of or in addition to the rotatable key bar 30. Thus, many variations are within the scope of the disclosure and are not limited to the illustrated example.

As further shown in FIGS. 1A and 1B, the attachment system 16 may include attachment arms 34 to accommodate different heights of various docks D and to counteract twisting or torsional movements between the dock D and the platform 12 such as may result from wake or wave action of the water. Also shown, the attachment system 16 may include a storage bin or compartment 36 that may extend between the attachment arms 34 and attach between the dock D and the platform 12. The storage bin 36, for example, can be used to store fishing rods, skis, paddles, life vests and the like. Moreover, the additional structure provided by the storage bin 36 can assist in counteracting of the torsion and torquing caused by wave action as noted above and described in further detail with respect to FIG. 6 below.

As further shown in FIGS. 1A and 1B, the jet ski J may be driven onto the insert 14 by powering the jet ski J onto an end of the platform 12 and the insert 14 to dock upon the jet ski ramp 10. Although the jet ski J may be docked upon the jet ski ramp 10 under its own power as shown, a winch or other external device or mechanism (not shown) may also be utilized. Ideally, an engine (not shown) of the jet ski J may be extended over an end of the jet ski ramp 10 for reinsertion into the water, and the docking process reversed to undock the jet ski J from the jet ski ramp 10.

Having described the jet ski ramp 10 in general terms, those skilled in the art will further understand that the platform 12, the insert 14 and the attachment system 16, and other modular, removable and replaceable components of the jet ski ramp system 10 may be sized and shaped differently and located at different positions other than the examples shown.

Figure 2:
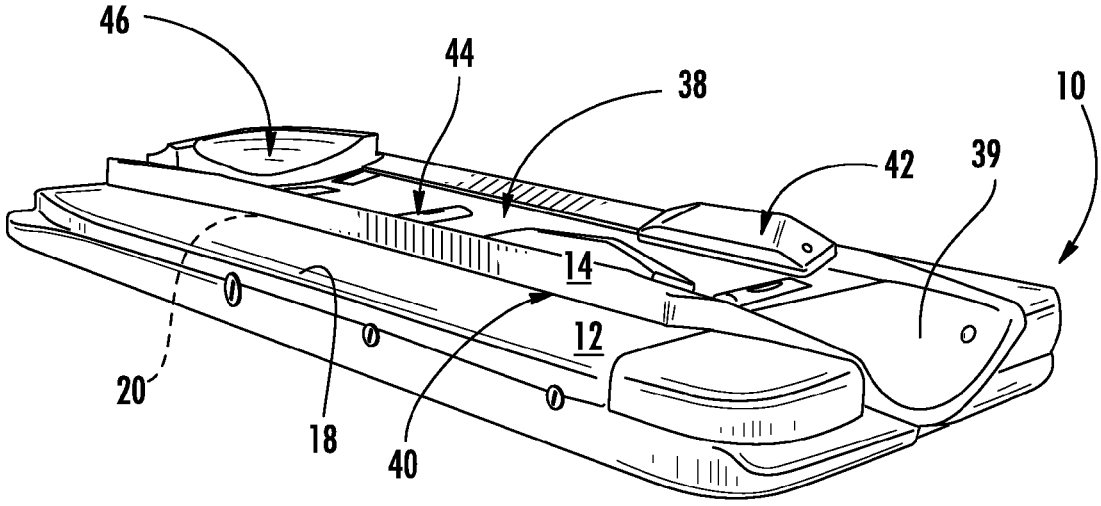
FIG. 2 is a perspective end view of the jet ski ramp as in FIGS. 1A and 1B.

Turning now to FIG. 2, the jet ski ramp system 10 is shown without a jet ski for clarity. As shown, the platform 12 may include non-skid walking surfaces 18 and a receptacle 20 for attachment of the insert 14 which is described below. The insert 14 includes a generally concave-shaped docking surface 38 to receive a jet ski. The docking surface 38 includes a ramp end 39 and replaceable bunks 42 to help guide the jet ski during docking and undocking maneuvers, as will be discussed in further detail with respect to FIGS. 5A-C below.

FIG. 2 also shows one or more rollers 44, which are arranged in the docking surface 38 to further guide the jet ski and facilitate docking and undocking maneuvers. A replaceable bow guide 46 may be provided to halt forward movement of the jet ski during docking and to cradle a bow of the jet ski while the jet ski is docked on the jet ski ramp 10.

Figure 3:
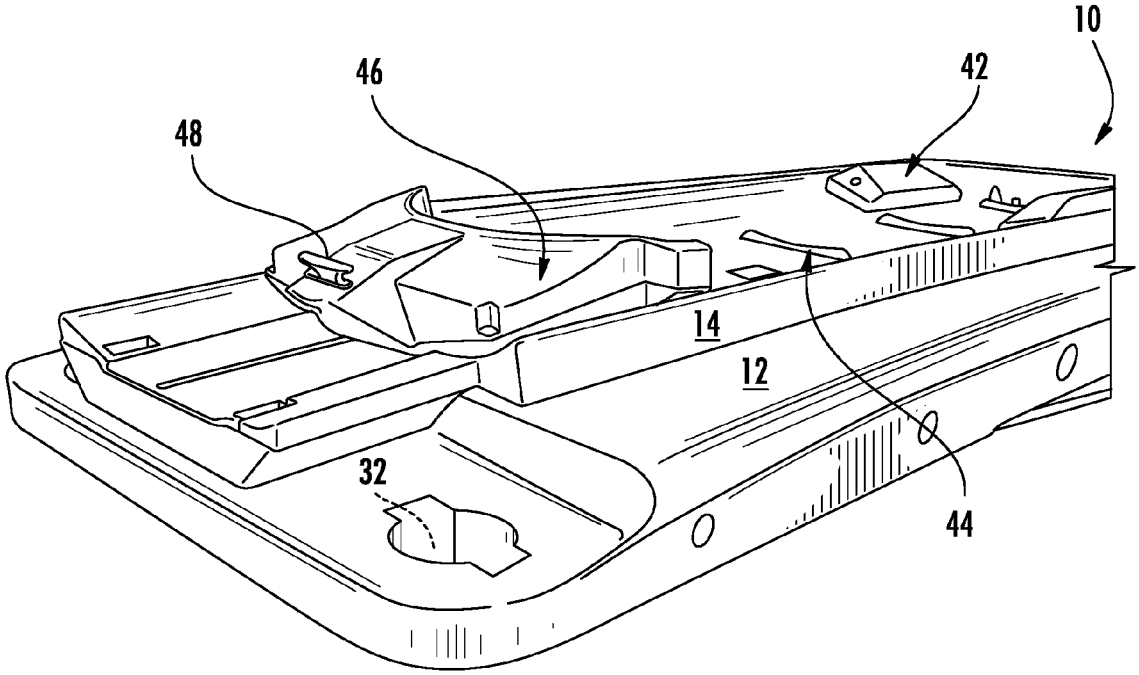
FIG. 3 is a partial perspective view of another end of the jet ski ramp as in FIGS. 1A and 1B.

FIG. 3 most clearly shows the replaceable bow guide 46, which, like the platform 12, may be made of a durable weather resistant material such as polyethylene or high density polyethylene (HDPE). In this example, the replaceable bow guide 46 includes one or more cleats or other attachment devices 48 for securing lines to and from the jet ski ramp 10. Also shown in FIG. 3 are additional perspectives of the keyholes 32, the bunks 42 and the rollers 44 as described above. The rollers 44 in particular may be removed and replaced should they wear out, or the heights and angles of the rollers 44 may be adjusted to accommodate variations in jet ski hulls.

Figure 4:
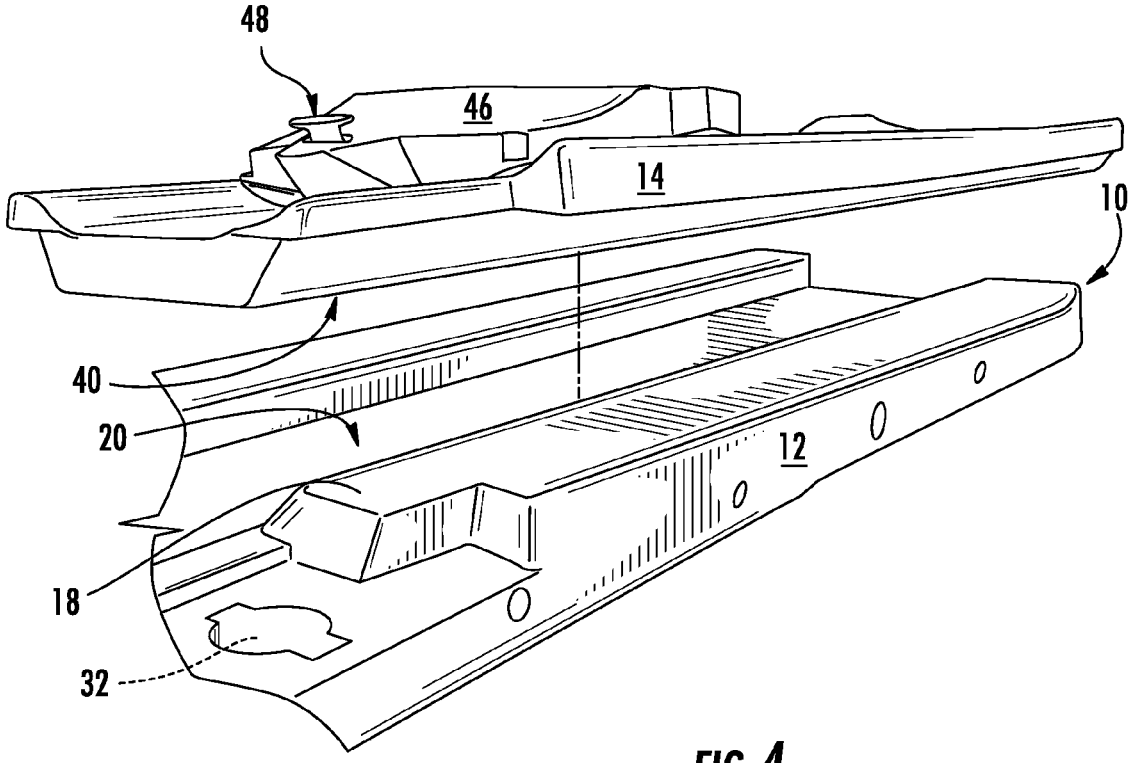
FIG. 4 is a partial perspective view of the jet ski ramp as in FIGS. 1A and 1B, particularly showing a wear surface being installed or removed or replaced according to an aspect of the disclosure.

Turning now to FIG. 4, details of the platform 12 and the insert 14 are most clearly shown in this exploded view in which the insert 14 is either being inserted or removed from the platform 12. As shown, the insert 14 has an attachment surface 40 that is shaped complementary to the receptacle 20 of the platform 12 briefly introduced above. The insert 14 may be mechanically attached to the platform 12 after the receptacle 20 and the attachment surface 40 are mated together, such as by latches, straps or screws (not shown). Although adhesives also may be used to connect the platform 12 and the insert 14 together if desired, releasable attachment mechanisms or devices such as snaps or latches are preferred to provide easy removal and service or replacement of the insert 14 as described above.

Figure 5A:
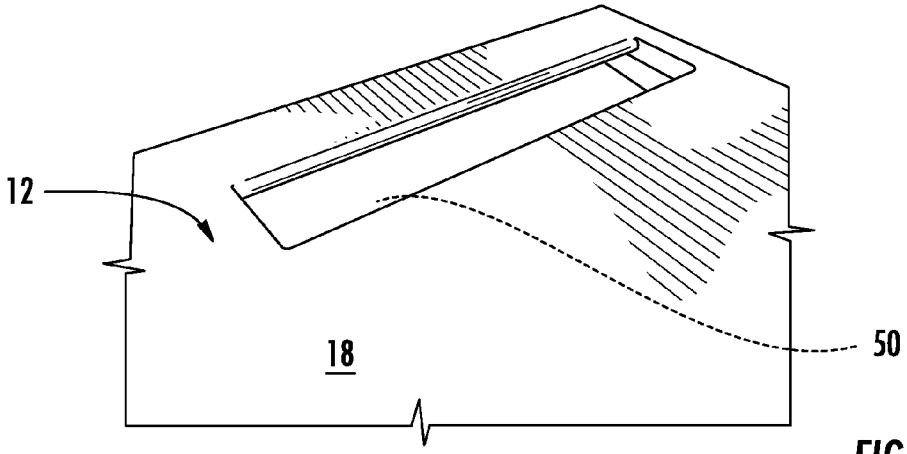
FIGS. 5A, 5B, and 5C show another aspect of the disclosure in which a removable bunk is being installed in a partial view of the jet ski ramp as in FIGS. 1A and 1B.
Figure 5B:
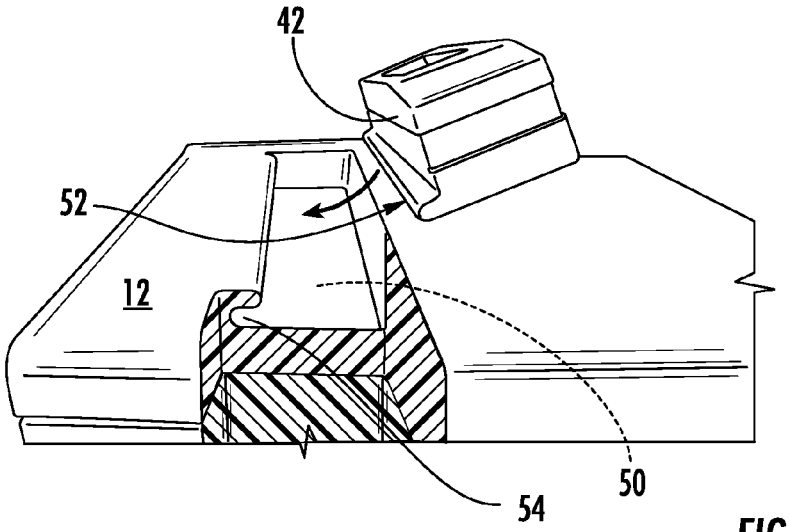
Figure 5C:
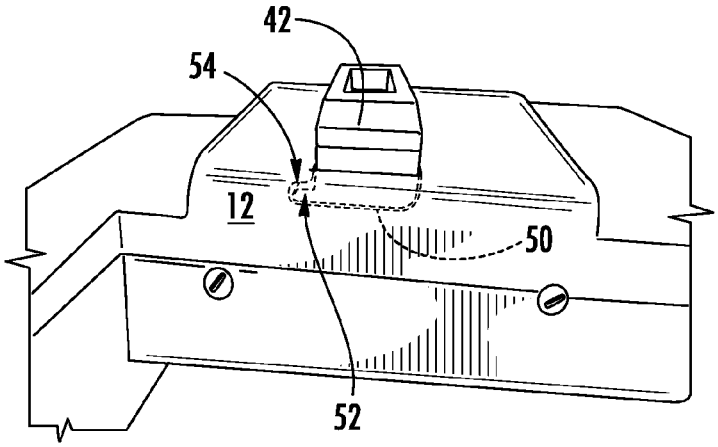

FIGS. 5A, 5B, and 5C show further details of the replaceable bunks 42 that may be used with the platform 12. The insert 14 may also include the same or similar features such as a bunk aperture 50 defined near the surface 18 of the platform 12. The bunk aperture 50 further includes, as most particularly shown in FIG. 5B, a groove or other female-shaped receptacle 54 for reception of a complementary lip or ledge 52 of the bunk 42. As shown, the bunk 42 is placed ledge-first into the bunk aperture 50. Once the ledge 52 is inserted in the groove 54, the bunk 42 may be press-set into the bunk aperture 50. As introduced above, the bunk 42 assists in guiding the jet ski J onto the jet ski ramp 10. Like many other components of the jet ski ramp 10, if the bunk 42 needs maintenance or replacement or a taller bunk is required to accommodate a larger jet ski, the process of inserting the bunk 42 may be reversed and the bunk 42 may be removed or replaced.

Figure 6A:
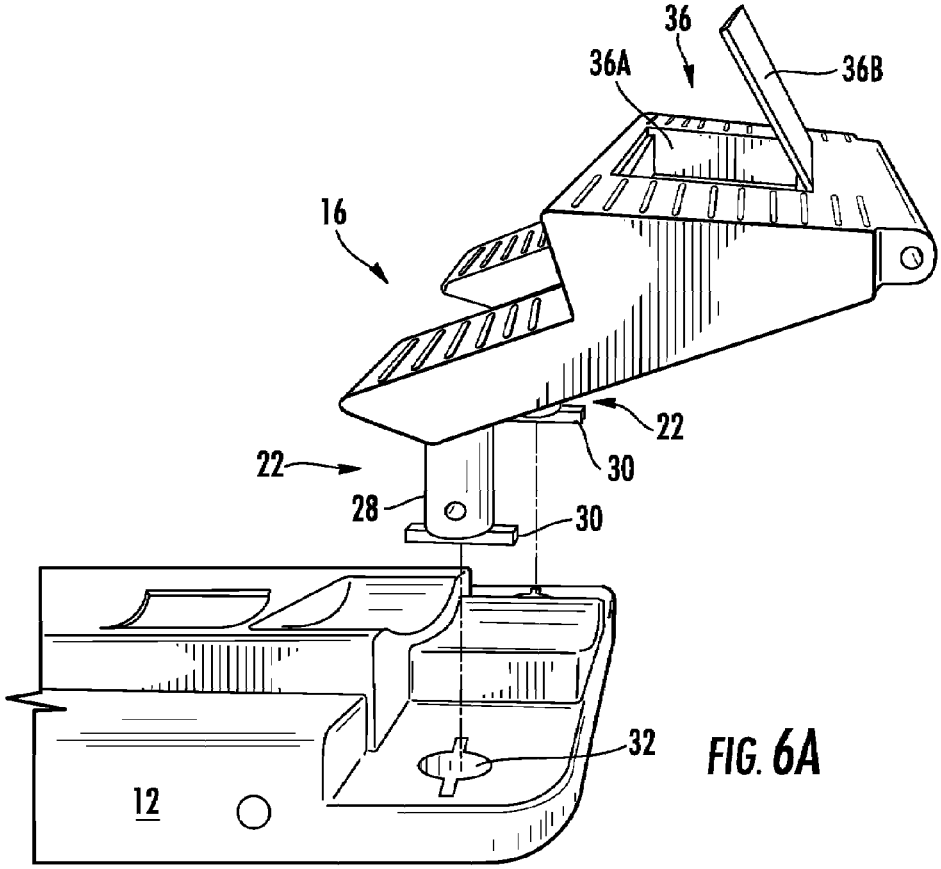
FIGS. 6A, 6B, and 6C are perspective views of a bin according to another aspect of the disclosure, the bin being attached to a dock and to the jet ski ramp as in FIGS. 1A and 1B.
Figure 6B:
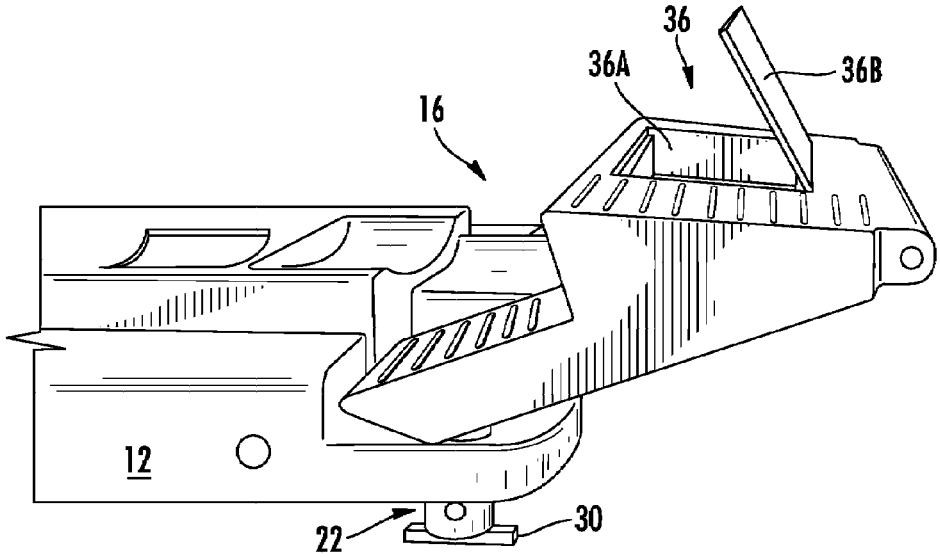
Figure 6C:
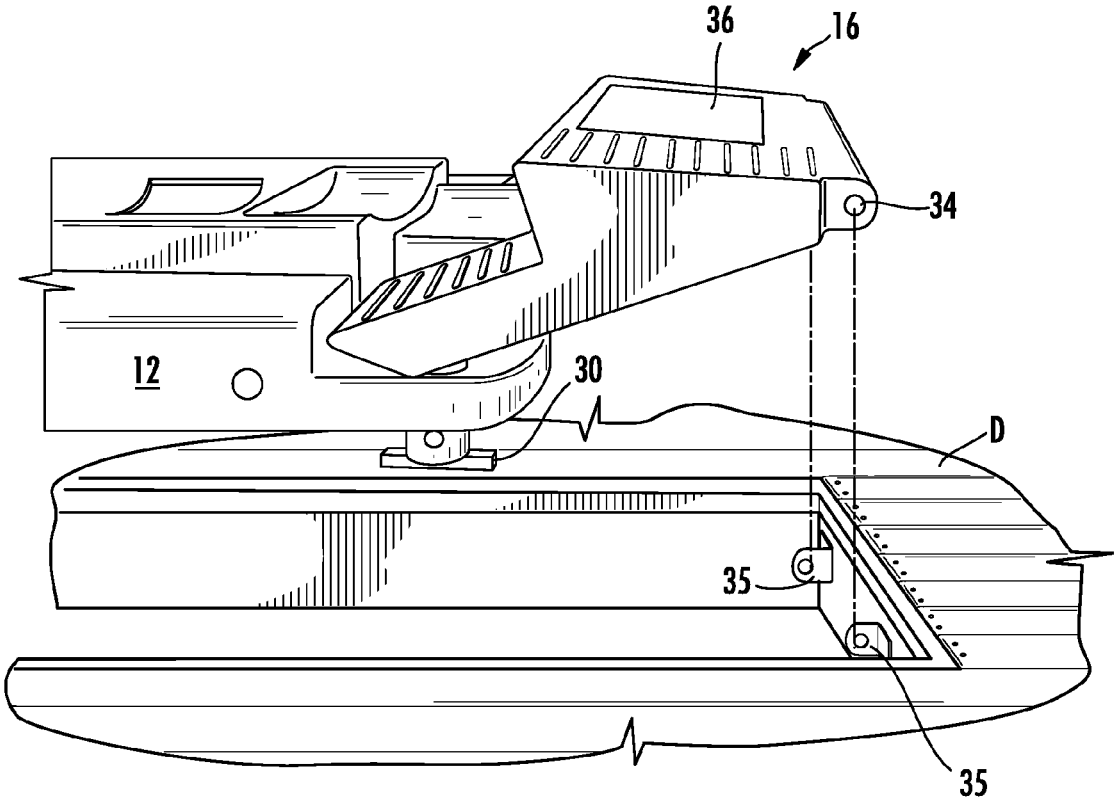

Turning now to FIGS. 6A-6C, the attachment system 16 briefly introduced above is shown most clearly. The attachment system 16 may have a plurality of keys 22 that insert in respective keyholes 32 of the platform 12. As shown in FIGS. 6B and 6C, the attachment system 16 connects to the platform 12 and to the dock D. More specifically, the attachment arms 34 may be bolted, snapped into or otherwise attached to dock fittings 35. The attachment system 16 may desirably pitch somewhat relative to dock D but its additional structure opposes twisting action of the platform 12 during docking of the jet ski J (see FIGS. 1A and 1B) during wave action or while walking upon the platform 12. As further shown, the storage bin 36 of the attachment system 16 includes a compartment 36A that may be covered when not in use by a lid or cover 36B. As noted above, the compartment 36A is handy for storing life vests, lines and the like for convenient use with the jet ski J, rather than having to carry such gear from a remote storage area to the dock D.

Figure 7:
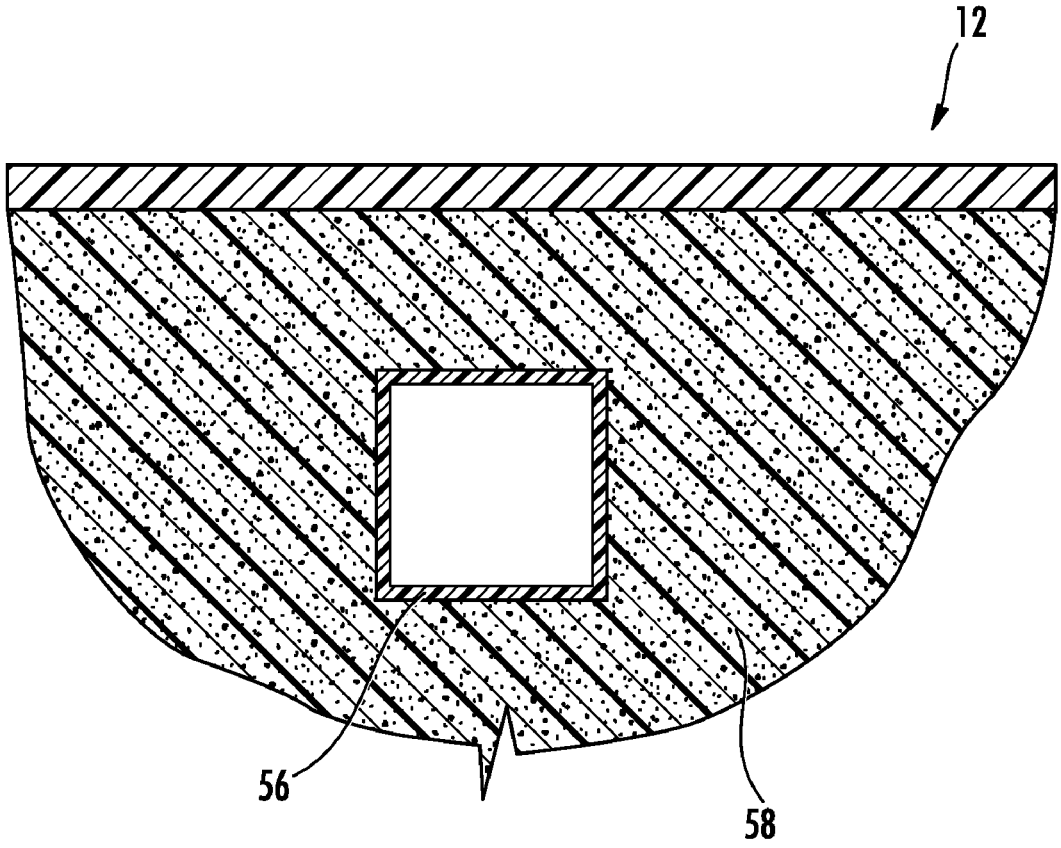
FIG. 7 shows a partial cross-section of the jet ski ramp as in FIGS. 1A and 1B.

With reference now to FIG. 7, the platform 12 is shown partially cut away to reveal an endoskeleton 56. The endoskeleton 56 may be one or more thick plastic or metallic bars or beams that are embedded within the platform 12 to protect the endoskeleton 56 from marine life and growth, as well as from corrosion and breakdown due to weather exposure. The endoskeleton 56 counteracts platform twisting, bowing, or bending while the jet ski ramp 10 is under load such as from weight from the jet ski being launched or docked upon the jet ski ramp 10. Also shown in FIG. 7, foam flotation 58 such as polystyrene may be injected in the platform 12 about the endoskeleton 56 to provide further floatation to the jet ski ramp 10, as well as for additional protection of the endoskeleton 56.

While preferred embodiments of the disclosure have been shown and described, those skilled in the art will recognize that other changes and modifications may be made to the foregoing examples without departing from the scope and spirit of the disclosure. For instance, dimensions such as heights of bunks or lengths and widths of the platforms and/or surface areas may be changed to accommodate various jet ski requirements. Likewise, different materials such as durable elastomeric and plastic materials can be used to manufacture the components described herein and are not limited to the examples mentioned. It is intended to claim all such changes and modifications as fall within the scope of the appended claims and their equivalents. Moreover, references herein to first and second ends or sides and female and male structures and the like, are intended solely for purposes of providing an enabling disclosure and in no way suggest limitations regarding orientations or orders of the exemplary embodiments or any components thereof.

The invention claimed is:

1. A modular jet ski ramp comprising:

a buoyant platform for attachment to a dock, the platform defining a receptacle thereon; and a first replaceable insert having a docking surface and an attachment surface, the docking surface being complementary to a hull of a first jet ski, the attachment surface being complementary to the receptacle for attachment thereto, wherein the first replaceable insert is readily removed from the platform and wherein the receptacle of the platform accommodates the attachment of a second replaceable insert having a docking surface complementary to one of the hull of the first jet ski and another jet ski having a different hull.

2. The modular jet ski ramp as in claim 1, wherein the platform comprises a polyethylene shell having foam floatation disposed therein.

3. The modular jet ski ramp as in claim 1, wherein the platform comprises a polyethylene shell having polystyrene disposed therein.

4. The modular jet ski ramp as in claim 1, further comprising a replaceable bow guide removably attached to one of the platform and the insert, the replaceable bow guide having a concave shape suited to guide and stop the jet ski upon docking.

5. The modular jet ski ramp as in claim 1, further comprising at least two replaceable bunks removably attached to one of the platform and the insert, the replaceable bunks shaped to facilitate the docking and undocking of the jet ski.

6. The modular jet ski ramp as in claim 1, wherein the insert includes at least one removable roller disposed upon the docking surface.

7. The modular jet ski ramp as in claim 1, further comprising an attachment system for attaching the platform to the dock, the attachment system including attachment arms and an equipment storage compartment, the attachment system providing additional structure to prevent torsion between the platform and the dock.

8. The modular jet ski ramp as in claim 1, further comprising an endoskeleton embedded within the platform, the endoskeleton counteracting platform twisting or bending.

9. The modular jet ski ramp as in claim 1, wherein the platform further includes a non-skid surface disposed proximate the insert.

10. A modular jet ski ramp comprising:

a buoyant platform for attachment to a dock, the platform defining a receptacle thereon; and a first replaceable insert having a docking surface and an attachment surface, the docking surface being complementary to a hull of a first jet ski, the attachment surface being complementary to the receptacle for attachment thereto, wherein the first replaceable insert is readily removed from the platform and replacement to wherein the receptacle of the platform accommodates the attachment of a second replaceable insert having a docking surface complementary to one of the hull of the first jet ski and another jet ski of a different size, and wherein the replaceable insert includes at least one removable roller disposed upon the docking surface.

11. The modular jet ski ramp of claim 10, further comprising a replaceable bow guide removably attached to one of the platform and the insert, the replaceable bow guide having a concave shape suited to guide and stop the jet ski upon docking.

12. The modular jet ski ramp of claim 10, further comprising at least two replaceable bunks removably attached to one of the platform and the insert, the replaceable bunks shaped to facilitate the docking and undocking of the jet ski.

13. The modular jet ski ramp of claim 10, further comprising an attachment system for attaching the platform to the dock, the attachment system including attachment arms and an equipment storage compartment, the attachment system providing additional structure to prevent torsion between the platform and the dock.

14. The modular jet ski ramp of claim 10, further comprising an endoskeleton embedded within the platform, the endoskeleton making the platform rigid.

15. A modular jet ski ramp comprising:

a buoyant platform for attachment to a dock, the platform defining a receptacle thereon;

a first replaceable insert having a docking surface and an attachment surface, the docking surface being complementary to a hull of a first jet ski, the attachment surface being complementary to the receptacle for attachment thereto, wherein the first replaceable insert is readily removed from the platform and wherein the receptacle of the platform accommodates the attachment of a second replacement insert having a docking surface complementary to one of the hull of the first jet ski and another jet ski having a different hull; and an attachment system for attaching the platform to the dock, the attachment system including attachment arms and an equipment storage compartment, the attachment system providing additional structure to prevent torsion between the platform and the dock.

16. The modular jet ski ramp as in claim 15, wherein the attachment system includes a key, the platform further including a keyhole for reception therein of the key.

* * * * *